US009828958B2

(12) United States Patent
Saito

(10) Patent No.: US 9,828,958 B2
(45) Date of Patent: Nov. 28, 2017

(54) HIGH-PRESSURE FUEL SUPPLY PUMP

(75) Inventor: Atsuji Saito, Kasama (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 772 days.

(21) Appl. No.: 13/414,334

(22) Filed: Mar. 7, 2012

(65) Prior Publication Data

US 2012/0227711 A1 Sep. 13, 2012

(30) Foreign Application Priority Data

Mar. 8, 2011 (JP) ..... 2011-049762

(51) Int. Cl.
*F02M 59/46* (2006.01)
*F02M 55/04* (2006.01)
*F02M 63/00* (2006.01)

(52) U.S. Cl.
CPC ..... *F02M 59/462* (2013.01); *F02M 55/04* (2013.01); *F02M 63/005* (2013.01); *F02M 2200/60* (2013.01)

(58) Field of Classification Search
CPC .. F02M 2200/60; F02M 55/04; F02M 59/462; F02M 63/005
USPC ..... 123/446, 447, 456, 457, 458, 459, 461, 123/506; 417/283, 456, 458, 496; 137/493, 493.3, 493.6, 493.8, 493.9, 512, 137/512.1, 515.5, 516.25, 505.11
See application file for complete search history.

(56) References Cited

U.S. PATENT DOCUMENTS 3,620,648 A * 11/1971 Hofer et al. ..... 417/73
4,032,266 A * 6/1977 Roeder ..... 417/571
4,033,375 A * 7/1977 Hirsch ..... 137/493.9
4,078,882 A 3/1978 Houd
4,165,725 A 8/1979 George et al.
4,409,939 A * 10/1983 Eheim et al. ..... 123/357
4,577,606 A * 3/1986 Bohringer et al. ..... 123/506
4,648,369 A * 3/1987 Wannenwetsch ..... 123/467
4,649,883 A * 3/1987 Bohringer ..... F02M 59/361 123/449

(Continued)

FOREIGN PATENT DOCUMENTS

EP 0 142 008 A2 5/1985
EP 0 325 211 A1 1/1989

(Continued)

OTHER PUBLICATIONS

Japanese Office Action dated Apr. 22, 2013 with partial English translation (seven (7) pages).

(Continued)

*Primary Examiner* — Carlos A Rivera
*Assistant Examiner* — Carl Staubach
(74) *Attorney, Agent, or Firm* — Crowell & Moring LLP

(57) ABSTRACT

A valve seat member shared by an outlet valve and a pressure relief valve is provided between a pressurizing chamber and a high pressure path. A valve seat of the relief valve is provided on the side of the pressurizing chamber of the valve seat member. A valve seat of the outlet valve is provided in the valve seat member on the side of the high pressure path. One end of a relief path whose other end is open in the valve seat of the pressure relief valve is connected with the high pressure path, and one end of an outlet path whose other end is open in the valve seat of the outlet valve is connected with the pressurizing chamber.

14 Claims, 6 Drawing Sheets

(56) References Cited

U.S. PATENT DOCUMENTS

| | | | | |
|---|---|---|---|---|
| 4,693,227 | A | 9/1987 | Satou | |
| 4,763,631 | A * | 8/1988 | Fehlmann | F02M 45/12 123/449 |
| 5,364,243 | A * | 11/1994 | Ishimoto | F02M 59/24 123/503 |
| 5,873,346 | A * | 2/1999 | Haberland | F02M 41/126 123/449 |
| 7,086,388 | B2 * | 8/2006 | Roth | F16K 17/196 123/510 |
| 7,086,413 | B2 * | 8/2006 | Yu | B62D 5/062 137/493 |
| 7,152,583 | B2 | 12/2006 | Abe et al. | |
| 9,181,944 | B2 * | 11/2015 | Kuroyanagi | F04B 49/035 |
| 2004/0069963 | A1 | 4/2004 | Mattes et al. | |
| 2007/0110603 | A1 * | 5/2007 | Usui et al. | 417/505 |
| 2008/0056914 | A1 * | 3/2008 | Usui et al. | 417/307 |
| 2009/0068041 | A1 * | 3/2009 | Beardmore | 417/540 |
| 2011/0126804 | A1 | 6/2011 | Lucas et al. | |
| 2012/0118269 | A1 * | 5/2012 | Ferry et al. | 123/459 |
| 2013/0280112 | A1 | 10/2013 | Usui et al. | |
| 2013/0306033 | A1 * | 11/2013 | Kato et al. | 123/472 |
| 2014/0014074 | A1 * | 1/2014 | Sahini et al. | 123/506 |
| 2014/0255219 | A1 * | 9/2014 | Lucas | 417/282 |

FOREIGN PATENT DOCUMENTS

| | | | |
|---|---|---|---|
| EP | 1 411 238 | A1 | 4/2004 |
| EP | 1 898 084 | A1 | 3/2008 |
| GB | 2 058 948 | A | 4/1981 |
| GB | 2 107 801 | B | 6/1985 |
| GB | 2 269 209 | A | 2/1994 |
| JP | 53-8421 | A | 1/1978 |
| JP | 54-30124 | | 2/1979 |
| JP | 56-41157 | U | 9/1979 |
| JP | 58-131355 | A | 8/1983 |
| JP | 60-119367 | A | 6/1985 |
| JP | 62-85167 | A | 4/1987 |
| JP | 3-92563 | U | 9/1991 |
| JP | 4-237868 | A | 8/1992 |
| JP | 5-27673 | U | 4/1993 |
| JP | 6-159195 | A | 6/1994 |
| JP | 6-87665 | U | 12/1994 |
| JP | 2003-35212 | A | 2/2003 |
| JP | 2003-120461 | A | 4/2003 |
| JP | 2003-343395 | A | 12/2003 |
| JP | 2004-138062 | A | 5/2004 |
| JP | 2004-197834 | A | 7/2004 |
| JP | 2004-218547 | A | 8/2004 |
| JP | 2006-207451 | A | 8/2006 |
| JP | 2007-138762 | A | 6/2007 |
| JP | 2007-218213 | A | 8/2007 |
| JP | 2008-57451 | A | 3/2008 |
| JP | 2008-64013 | A | 3/2008 |
| JP | 2008-157252 | A | 7/2008 |
| JP | 2009-209801 | A | 9/2009 |
| JP | 2010-19263 | A | 1/2010 |
| JP | 4415929 | B2 | 2/2010 |
| JP | 4488486 | B2 | 6/2010 |
| WO | WO 2011/068524 | A1 | 6/2011 |

OTHER PUBLICATIONS

Extended European Search Report dated May 7, 2012 (five (5) pages).

Japanese Office Action dated Mar. 10, 2015, with English translation (Eighteen (18) pages).

Japanese Office Action issued in counterpart Japanese Application No. 2014-109660 dated Dec. 1, 2015, with English translation (Twelve (12) pages).

Japanese-language Office Action issued in counterpart Japanese Application No. 2014-109660 dated Aug. 9, 2016 with English translation (Thirteen (13) pages).

Japanese-language Office Action issued in counterpart Japanese Application No. 2014-109660 dated Jan. 10, 2017 with English translation (Nine (9) pages).

* cited by examiner

HIGH-PRESSURE FUEL SUPPLY PUMP

CLAIM OF PRIORITY

The present application claims priority from Japanese Patent application serial No. 2011-49762, filed on Mar. 8, 2011, the content of which is hereby incorporated by reference into this application.

TECHNICAL FIELD

The present invention relates to a high-pressure fuel supply pump for feeding high-pressure fuel to a fuel injection valve which directly injects fuel to a cylinder in an internal combustion engine. In particular, the present invention relates to a high-pressure fuel supply pump having a safety valve (also called a "pressure relief valve") installed into a pump body. When the pressure of discharged fuel or the pressure in the high-pressure fuel pipes including a fuel accumulator becomes abnormally high, the safety valve opens and returns the fuel to a pressurizing chamber located upstream of an outlet valve.

BACKGROUND ART

In Japanese Patent Laid-open No. 2004-138062 there is described a high-pressure fuel pump having a relief valve device, the relief valve device comprising a valve seat member having a central fuel path and a seat surface formed around the central fuel path, a valve body serving as a pressure relief valve for being placed against the seat surface, and a spring member for pushing the valve body against the seat surface, the relief valve device being mounted to a body of the pump in such a manner that the spring member is positioned on the pressurizing chamber side.

Japanese Patent No. 4415929 discloses a high-pressure fuel pump in which a valve seat is provided at an inlet, on the pressurizing chamber-side, of a path connecting the pressurizing chamber with the high pressure path, a pressure relieve valve is installed on the pressurizing chamber-side of the valve seat, and there is provided, on the side of the high pressure path, a spring mechanism for producing the pressing force so that the relief valve is pressed toward the valve seat.

CITATION LIST

Patent Literature

[PTL 1] Japanese Patent Laid-open No. 2004-138062 (Corresponding European Patent Publication: EP 1 411 238 A1)

[PTL 2] Japanese Patent No. 4415929 (Corresponding US Patent Publication: US 2007/0110603 A1)

SUMMARY OF INVENTION

Technical Problem

According to the above related art, however, a valve seat member of the outlet valve and a valve seat member of the pressure relief valve are provided respectively in each of the two independent communication paths for connecting the pressurizing chamber with the outlet path. Therefore, there required quite a number of steps for processing operation of the path and the assembly work (automatic assembly, in particular) of the two valves.

It is an object of the present invention to make it possible to provide a valve seat for the pressure relief valve and the outlet valve in a single path which connects the pressurizing chamber with the outlet path.

Solution to Problem

The object of the present invention is attained by providing one valve seat member shared by an outlet valve and a pressure relief valve between a pressurizing chamber and a high pressure path, providing a valve seat of the pressure relief valve on the pressurizing chamber-side of the valve seat member, providing a valve seat of the outlet valve on the high pressure path-side of the valve seat member, connecting one end of a relief path whose other end is open to the valve seat of the pressure relief valve with the high pressure path, connecting one end of an outlet path whose other end is open to the valve seat of the outlet valve with the pressurizing chamber, providing a relief valve structure on the pressurizing chamber-side of the valve seat of the pressure relief valve, and providing an outlet valve structure on the downstream side of the valve seat of the outlet valve.

Advantageous Effects of Invention

According to the present invention of the above construction, a single valve seat member serves as the valve seat for the pressure relief valve and the outlet valve, improving, generally, the processibility and easiness in assembly of the outlet valve and the pressure relief valve.

DESCRIPTION OF EMBODIMENTS

Figure 1:
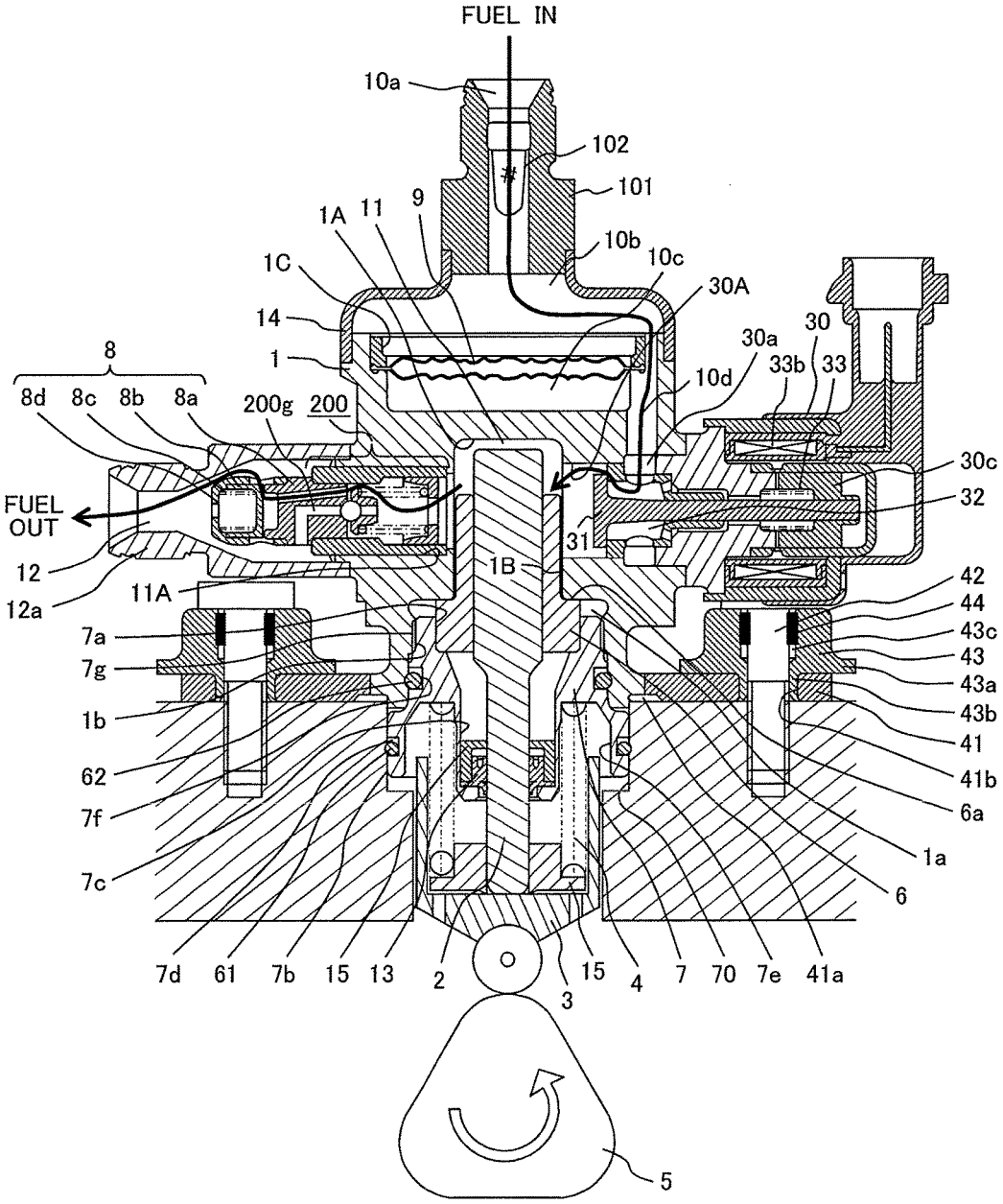
FIG. 1 is an entire longitudinal sectional view of a high-pressure fuel supply pump according to a first embodiment of the present invention.

According to the embodiments shown in the drawings, the present invention will be described in detail below.

EXAMPLE 1

A first embodiment of the present invention will be described hereinafter with reference to FIGS. 1 to 5.

Figure 4:
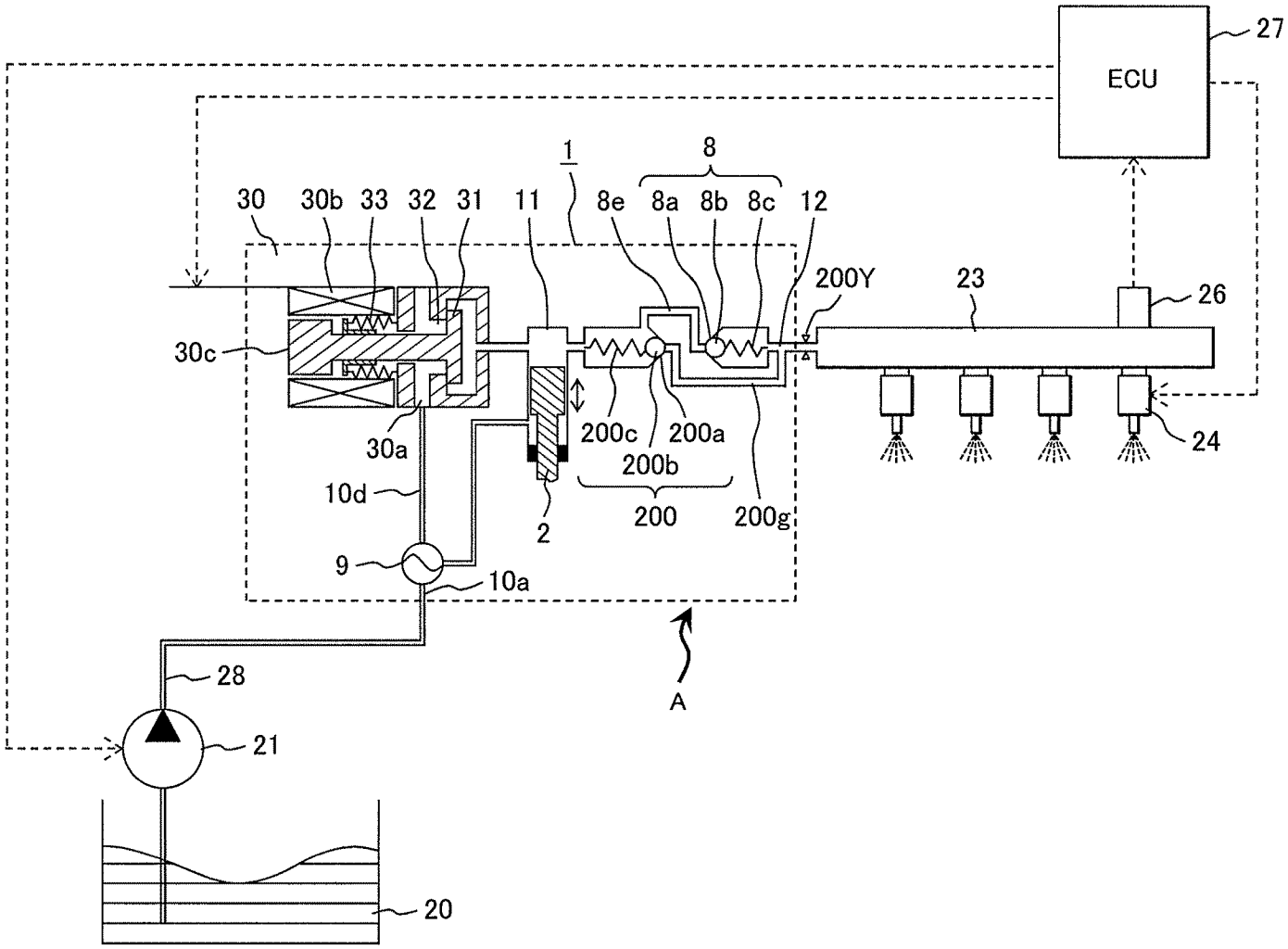
FIG. 4 shows an example of a fuel supply system using the high-pressure fuel supply pump of the first embodiment of the present invention.
Figure 5:
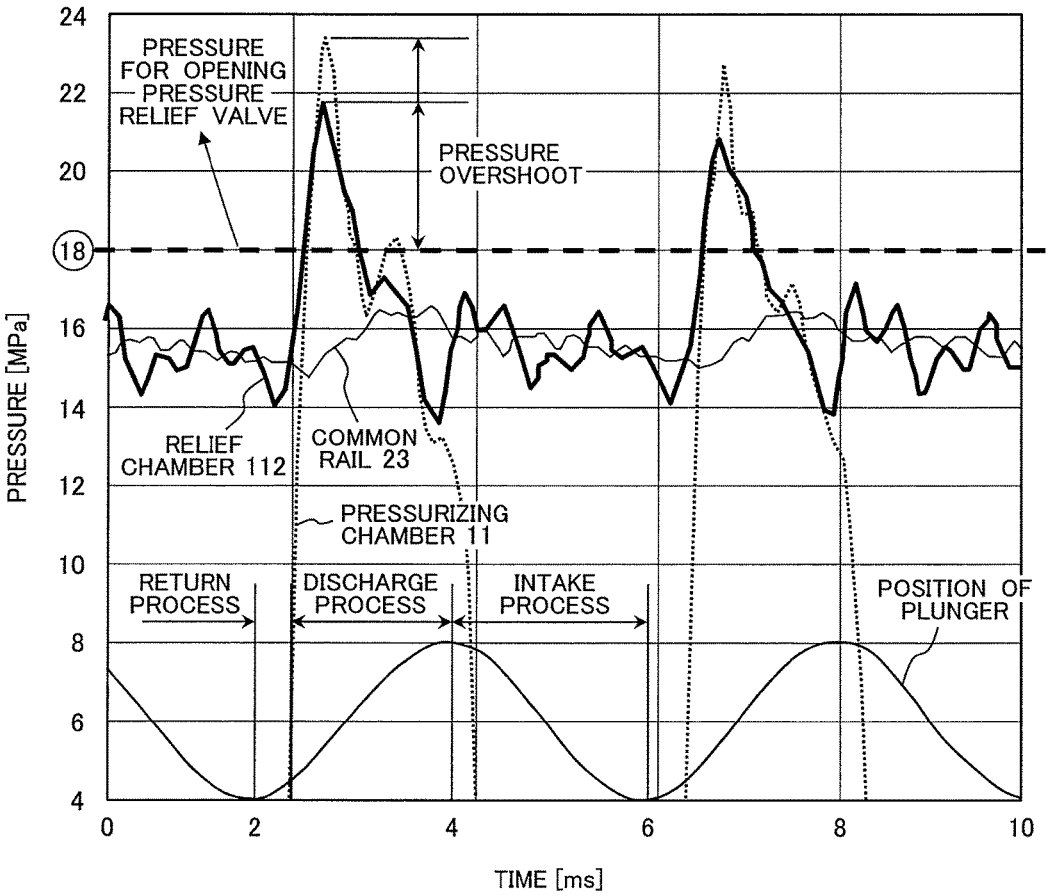
FIG. 5 shows pressure wave forms in various portions of the high-pressure fuel supply pump of the first embodiment of the present invention and in a common rail.

With reference to FIG. 4, there will be described the construction and operation of a fuel supply system which supplies high-pressure fuel to a fuel injection valve directly injecting fuel to a cylinder in an internal combustion engine. FIG. 4 is a general outline view of the fuel supply system.

The portion enclosed with a broken line A represents a pump body of a high-pressure fuel pump. An arrangement and parts inside the enclosing broken line are integrally installed in the pump body 1.

Fuel in a fuel tank 20 is pumped up by a feed pump 21 and is fed to an inlet joint 10*a* in the high-pressure pump body 1 through an intake pipe 28.

The fuel having passed through the inlet joint 10*a* then passes through a pressure pulsation reducing mechanism 9 and an inlet path 10*d*, and the fuel reaches an inlet port 30*a* of an electromagnetic inlet valve 30 constituting a flow rate control mechanism. As to the pressure pulsation reducing mechanism 9, a detailed description will be given later.

The electromagnetic inlet valve 30 includes a magnet coil 30*b*. In an energized state of the magnet coil 30*b*, an electromagnetic plunger 30*c* is attracted rightward in FIG. 1 and in this state a spring 33 is maintained in a compressed state. In this state, an inlet valve body 31 at one end of the electromagnetic plunger 30*c* opens an inlet port 32 communicating to a pressurizing chamber 11 in the high-pressure fuel pump.

When the magnet coil 30*b* is not energized and when there is no difference in fluid pressure between the inlet path 10*d* (inlet port 30*a*) and the pressurizing chamber 11, the inlet valve body 31 is exerted in its closing direction with the pressing force of a spring 33 to close the inlet port 32.

More specifically, the following operations are performed.

When a plunger 2 moves downward in FIG. 1 with rotation of a cam to be described later and the pump is in its intake process, the volume of the pressurizing chamber 11 increases and the internal fuel pressure of the pressurizing chamber 11 decreases. In this intake process, when the internal fuel pressure of the pressurizing chamber 11 becomes lower than that of the inlet path 10*d* (inlet port 30*a*), a valve opening force (a force which induces a leftward movement in FIG. 1 and rightward movement in FIG. 4 of the inlet valve body 31) based on a fluid pressure difference of fuel is given to the inlet valve body 31.

The inlet valve body 31 is set so as to overcome the pressing force of the spring 33 to open the inlet port 32 by this valve opening force based on the fluid pressure difference.

In this state, when a control signal is applied from an engine control unit 27 ("ECU" hereinafter) to the electromagnetic inlet valve 30, an electric current flows through the magnet coil 30*b* of the electromagnetic inlet valve 30, so that the electromagnetic plunger 30*c* moves leftward in FIG. 1 (rightward in FIG. 4) with a magnetic force, whereby a compressed state of the spring 33 is maintained. As a result, the inlet valve body 31 maintains the inlet port 32 open state.

When the plunger 2 completes its intake process and shifts to its pressurizing process (an upwardly moving state in FIG. 1) while voltage is applied to the electromagnetic inlet valve 30, the inlet valve body 31 remains in the open state since the magnet coil 30*b* maintains in its continuing energized state.

The volume of the pressurizing chamber 11 decreases with the compressing motion of the plunger 2, but in this state the internal pressure of the pressurizing chamber 11 does not rise because the fuel having been taken in the pressurizing chamber 11 is again returned to the inlet path 10*d* (inlet port 30*a*) through the inlet valve body 31 which is open. This process is called a "fuel return process".

In this fuel return state, when the control signal provided from the ECU 27 is turned-off to de-energize the magnet coil 30*b*, the magnetic force exerted to the electromagnetic plunger 30*c* becomes extinct after the lapse of a certain time (after a magnetic and mechanical delay time). Since the pressing force of the spring 33 exerts to the inlet valve body 31, so when the electromagnetic force exerting to the plunger 30*c* becomes extinct, the inlet valve body 31 closes the inlet port 32 under the pressing force of the spring 33. Upon closing of the inlet port 32, the fuel pressure in the pressurizing chamber 11 rises with the rising motion of the plunger 2. Then, when the fuel pressure becomes equal to or higher than the pressure of a high pressure path 12, the fuel remaining inside the pressurizing chamber 11 is discharged at a high pressure through an outlet valve structure (outlet valve device) 8 and is fed to a common rail 23. This process is called a "discharge process". That is, the pressurizing process (a rising stroke from the bottom dead center to the top dead center) comprises the return process and the discharge process.

By controlling the timing of de-energizing the magnet coil 30*c* in the electromagnetic inlet valve 30, it is possible to control the delivery amount of the high-pressure fuel. If the timing of de-energizing the magnet coil 30*c* is advanced, then in the pressurizing process, the ratio of the return process is small and that of the discharge process is large. That is, the amount of the fuel returned to the inlet path 10*d* (inlet port 30*a*) is small and that of the fuel discharged at a high pressure is large. In contrast to this, if the timing of de-energizing the magnet coil 30*c* is delayed, then in the pressurizing process, the ratio of the return process is large and that of the discharge process is small. That is, the amount of the fuel returned to the inlet path 10*d* (inlet port 30*a*) is large and that of the fuel discharged at a high pressure is small. The timing of de-energizing the magnet coil 30*c* is controlled in accordance with an instruction provided from the ECU.

In the above arrangement, by controlling timing of de-energizing the magnet coil 30*c*, the delivery amount of the high-pressure fuel can be controlled in accordance with the amount required by the internal combustion engine.

An outlet of the pressurizing chamber 11 is provided with the outlet valve structure 8. The outlet valve structure 8 includes an outlet valve seat 8*a*, an outlet valve 8*b*, and an outlet valve spring 8*c*. When there is no fuel pressure difference between the pressurizing chamber 11 and the high pressure path 12, the outlet valve 8*b* is put in pressurized contact with the outlet valve seat 8*a* with the pressing force of the outlet valve spring 8*c* and is closed. Only when the internal fuel pressure of the pressurizing chamber 11 becomes higher than the pressure of the high pressure path 12, the outlet valve 8*b* opens against the outlet valve spring 8*c*. Thereby the fuel in the pressurizing chamber 11 is discharged at a high pressure to the common rail 23 through the high pressure path 12. In this regard, the fuel flows into the outlet valve 8*a* through a relief valve structure (relief valve device) 200. The pressure relief valve itself, however, remains closed, not opening.

Thus, a required amount of the fuel in the fuel inlet port 10*a* is pressurized to a high pressure by the reciprocating motion of the plunger 2 within the pressurizing chamber 11 in the pump body 1 and the high-pressure fuel is fed to the common rail 23 from the high pressure path 12.

The common rail 23 is provided with the injectors 24 and a pressure sensor 26. The injectors 24 are prepared corresponding to the number of cylinders in the internal combustion chamber. The injectors 24 open and close in accordance with control signals provided from the ECU 27 to inject fuel into the cylinders.

In addition to the outlet passage, the outlet valve seat 8*a* is further provided with a relief path 200*g* for communicating between the downstream side of the outlet valve 8*b* and the pressurizing chamber 11, while bypassing the outlet valve 8*b*.

The relief path 200*g* is provided with a pressure relief valve 200*b* which allows the flow of fuel in only one direction from the outlet passage to the pressurizing chamber 11. The pressure relief valve 200*b* is pressurized to a relief valve seat 200*a* with a relief spring 200*c* exerting a pressing force. The pressure relief valve 200*b* leaves from the relief valve seat 200*a* and opens when the difference in pressure between the pressurizing chamber and the relief path becomes equal to or higher than a prescribed pressure.

In the event of occurrence of an abnormally high pressure for example in the common rail 23 due to failure of an injector 24 and when the difference in pressure between the relief path 200*g* and the pressurizing chamber 11 becomes equal to or higher than the valve opening pressure, the pressure relief valve 200*b* opens and the fuel which has thus become an abnormally high pressure is returned to the pressurizing chamber 11 through the relief path 200*g*. Accordingly, pipes installed in high-pressure portions such as the common rail 23 are protected.

The arrangement and operation of the high-pressure fuel pump will be described below in more detail with reference to FIGS. 1 to 5.

The pressurizing chamber 11 is formed at central position of the pump body. Furthermore, the pump body is provided with the electromagnetic inlet valve 30 for feeding the fuel to the pressurizing chamber 11 and the outlet valve structure 8 for discharging the fuel from the pressurizing chamber 11 to the high pressure path 12. Further, a cylinder 6 for guiding a reciprocating motion of the plunger 2 is installed so as to face the pressurizing chamber 11.

The outer periphery of the cylinder 6 is held by a cylinder holder 7. The cylinder 6 is installed in the pump body 1 by engaging a male thread formed on the outer periphery of the cylinder holder 7 into a female thread formed on the pump body 1. The plunger 2 is adapted to perform the reciprocating motion within the pressurizing chamber 11, and the cylinder 6 holds the plunger 2 slidably in the directions of the reciprocating motion.

A tappet 3 is provided at a lower end of the plunger 2. The tappet 3 converts a rotational motion of a cam 5 mounted on a cam shaft of the engine into a vertical reciprocating motion and transfers the vertical reciprocating motion to the plunger 2. With a spring 4, the plunger 2 is put in pressurized contact with the tappet 3 through a retainer 15, whereby the plunger 2 can be reciprocated vertically with the rotational motion of the cam 5.

A plunger seal 13 is held at a lower end side portion of the inner periphery of the cylinder holder 7 in a state in which it is in slidable contact with the outer periphery of the plunger 2 at a lower end portion of the cylinder 6 in FIG. 1. With the plunger seal 13, a blow-by gap between the plunger 2 and the cylinder 6 is sealed to prevent the leakage of fuel to the exterior. At the same time, lubricating oil (including engine oil) for lubricating a sliding portion in the engine room is prevented from flowing into the pump body 1 through the blow-by gap.

A pressure pulsation reducing mechanism 9 for reducing the spread of pressure pulsation generated within the pump to the fuel pipe 28 is installed in a damper cover 14.

In the case where the fuel once taken in the pressurizing chamber 11 is returned to the inlet path 10*d* (inlet port 30*a*) again through the opened inlet valve body 31 because of the flow rate being controlled, pressure pulsation occurs in the inlet path 10 by the fuel returned to the inlet path 10. However, since the inlet path 10*c* as a damper chamber (formed between the cup-like damper cover 14 and an annular depression formed in the outer periphery of the pump body) is provided with a metallic damper 9, such a pressure pulsation is absorbed and diminished by expansion and contraction of the metallic damper 9. The metallic damper 9 is formed by jointing two corrugated metallic discs at their outer peripheries, with an inert gas such as argon being charged into the interior of the metallic damper 9.

With the outlet valve seat 8*a* and the relief valve seat 200*a* being configured by a single seat member, the outlet valve structure 8 and the relief valve structure 200 are formed as one piece. They are pressed from the outside toward the pressurizing chamber 11 into a cylindrical outlet opening 11A formed in the pressurizing chamber 11, and are held inside the cylindrical outlet opening 11A.

The fuel pressurized in the pressurizing chamber 11 flows through a hole 200*h* formed in the center of the relief valve stopper 200*f*, a gap of a helical relief valve spring 200*c*, and an outlet path 8*e* formed in a seat member (a relief valve seat 200*a*, an outlet valve seat 8*a*), into an outlet valve 8*b*.

When there is no fuel pressure difference between the pressurizing chamber 11 and the high pressure path 12, the outlet valve 8*b* of the outlet valve unit constructed as above is put in pressurized contact with the outlet valve seat 8*a* with the pressing force of the outlet valve spring 8*c* and is closed. Only when the internal fuel pressure of the pressurizing chamber 11 becomes higher than the pressure of the high pressure path 12, the outlet valve 8*b* opens against the outlet valve spring 8*c*. Thereby the fuel in the pressurizing chamber 11 is discharged at a high pressure to the common rail 23 through a passage hole formed in the outlet valve holder 8*d* and the high pressure path 12. In this regard, the fuel flows into the outlet valve through the relief valve structure 200. The pressure relief valve itself, however, remains closed, not opening.

According to the above construction, the outlet valve structure 8 serves as a check valve which restricts the fuel flowing direction.

Further, the operation of the relief valve structure will be described below in detail.

Figure 2A:
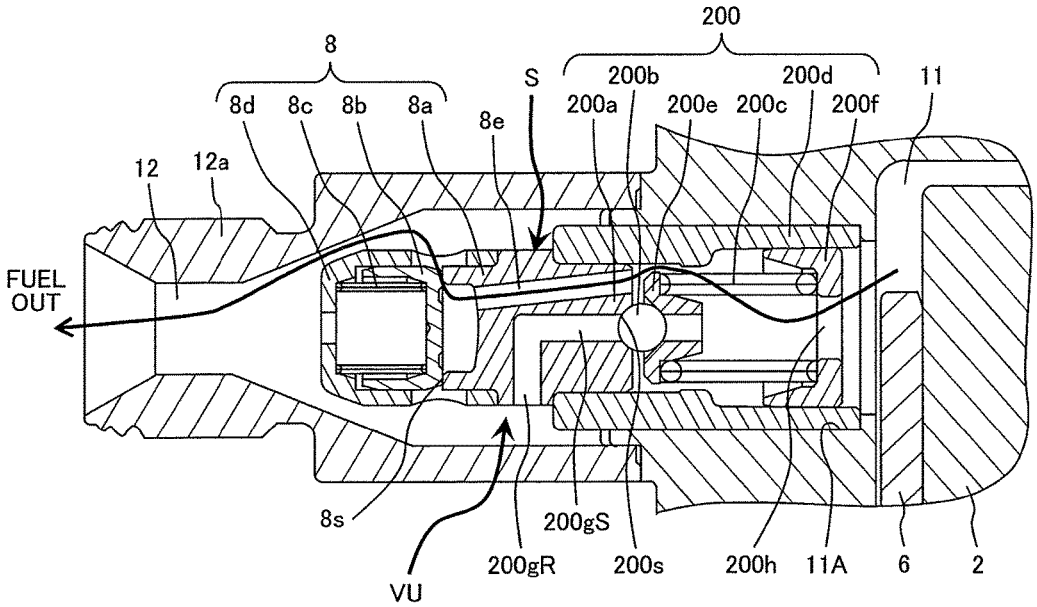
FIG. 2A is a partially enlarged view of the high-pressure fuel supply pump according to the first embodiment of the present invention, for explaining a part around a pressure relief valve, and is a diagram for showing a state in which the fuel is discharged.
Figure 2B:
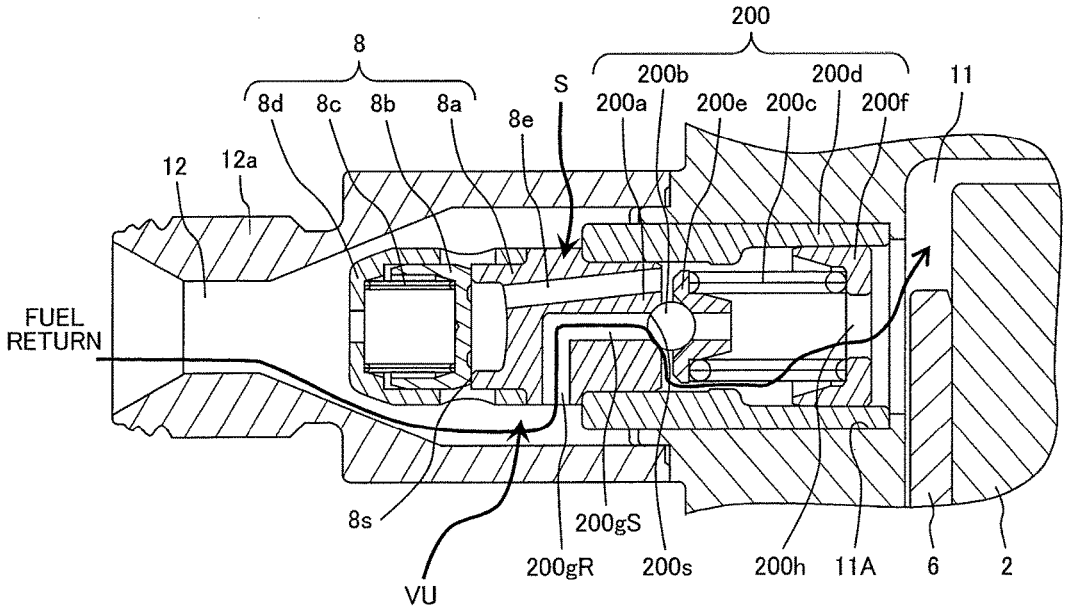
FIG. 2B is a partially enlarged view of the high-pressure fuel supply pump according to the first embodiment of the present invention, for explaining a part around the pressure relief valve, and is a diagram for showing a state in which the pressure relief valve is operated.

As shown in FIGS. 2A and 2B, the relief valve structure 200 comprises a relief valve seat 200*a*, a pressure relief valve 200*b*, a relief valve spring 200*c*, a relief valve body 200*d*, a ball valve holder 200*e*, and a relief spring stopper 200*f*.

By pressing the side of the relief valve seat 200*a* of the valve seat member S into an opening at one end of the cylindrical relief valve body 200*d* and fixed (or welded), a periphery of the relief valve seat 200*a* is enclosed by the relief valve body 200*d*. Inner members are held inside the cylindrical relief valve body 200*d* by inserting, from the side of the other end of the cylindrical relief valve body 200*d*, the pressure relief valve 200*b*, the ball valve holder 200*e*, and the relief valve spring 200*c* into the relief valve body 200*d* and pressing the relief valve spring stopper 200*f* to an inner peripheral face of the cylindrical relief valve body 200*d* and fixing them. The pressing force by the relief spring 200*c* can be set according to a position at which the relief valve spring stopper 200*f* is pressed in. The pressure of the pressure relief valve 200*b* to open the valve is determined by a prescribed value of the pressing force by the relief valve spring 200*c*. Further, it is possible that the relief valve spring stopper 200*f* is first pressed in and fixed, and then, the relief valve spring 200*c*, the ball valve holder 200*e*, and the relief valve 200*b* are installed in the cylindrical relief valve body 200*d*, and the valve seat member S is fixed to the opening at one end of the cylindrical relief valve body 200*d*. In this regard, adjustment can be made according to the position at which the cylindrical relief valve body 200*d* and the valve seat member S are pressed in.

On the side opposite to the relief valve seat 200*a* of the valve seat members S, the outlet valve seat 8*a* is formed. Further, the outlet valve seat 8*a* and the relief valve seat 200*a* are configured by a single valve seat member S. The outlet valve seat 8S has an annular projection formed at an outer edge of the end portion of the valve seat member S. An inner peripheral face of the open end side of the cup-like outlet valve holder 8*d* is fitted to the outer periphery of the valve seat member S and fixed there by welding or the like so that the outlet valve holder 8*d* encloses the outer periphery of the outlet valve seat 8*a*. An outlet valve spring 8*c* and a flat plate-like outlet valve 8*b* are installed inside the outlet valve holder 8*d*. The flat outlet valve 8*b* is pressed against the annular outlet valve seat 8S by the outlet valve spring 8*c*.

On the bore side of the outlet valve seat 8S, one end of the outlet path 8*e*, whose other end is open to the pressurizing chamber 11, is opened. Bypassing the relief path 200*g*S formed in the central part, the outlet path 8*e* is formed in a plural number inclined toward the periphery of the relief path 200*g*S. To be specific, one end of the outlet path 8*e* is opened in a portion located on the outer side in the radial direction from the central part where the relief path 200*g*S of the end portion of the valve seat member S on the side of the pressurizing chamber 11 is opened. Further, the other end of the outlet path 8*e* is opened in an end portion opposite to the pressurizing chamber 11 of the valve seat member S and, at the same time, in a portion located on the bore side of the outlet valve seat 8*a* projecting from the outer edge thereof. Consequently, the outlet path 8*e* is formed as a straight pipe path inclined, by the difference between opening positions of the two ends in the radial direction, to the central axis in the longitudinal direction of the seat member S. Accordingly, the required path-sectional area of the outlet path 8*e* can be secured without enlarging the diameter of the valve seat member S on the side of the outlet valve seat 8*a*.

On the other hand, the relief path 200*g* formed in the central part of the valve seat member S has a straight pipe portion 200*g*S whose one end is opened in a relief valve seat 200*s* formed on an end portion of the valve seat member S on the side of the pressurizing chamber 11. At a point passing the end portion of the relief valve body 200*d* on the side of the outlet valve, the straight pipe portion 200*g*S branches into two or more radial paths 200*g*R to be connected to the high pressure path 12 at an opening in the outer periphery of the valve seat member S.

Thus, the relief valve structure 200 and the outlet valve structure 8 are formed as a single unit VU.

The single unit of the outlet valve structure 8 and the relief valve structure 200, namely, the unit VU is fixed when an outer periphery of the relief valve body 200*d* of the unit VU is pressed into an inner peripheral wall of the cylindrical opening 11A formed in the pump body 1. Subsequently, an outlet joint 12*a* is so arranged as to cover the periphery of the outlet valve structure 8 of the unit VU and is fixed to the pump body 1 by welding or with use of screws.

The joint 12*a* serves as a joint of pipes for allowing high-pressure fuel to flow into the common rail 23, and the high pressure path 12 is formed therein.

Thus, by forming the relief valve structure 200 and the outlet valve structure 8 as one piece, an increase in the volume of the pressurizing chamber 11 can be minimized. Also, the diameter of the relief value device 200 is smaller than its dimension in the axial direction. Therefore, the dimension, in the reciprocating direction, of the plunger 2 of the high-pressure fuel supply pump can be smaller when the pressure relief valve is disposed in a direction perpendicular to the plunger 2, as in the present embodiment, than the case where the pressure relief valve is disposed in the same reciprocating direction of the plunger 2 of the high-pressure fuel supply pump.

Also, the fuel flowing from the pressurizing chamber 11 into the outlet valve structure 8 always passes through the inside of the relief valve structure 200. Therefore, particularly when starting the engine etc., bubbles of air or evaporated fuel is easily exhausted from the outlet valve 8*a*, preventing the lowering of compressibility due to such bubbles. Further, the occurrence of cavitation is suppressed. That is, as in the conventional case, when the relief path is formed at a position away from the outlet path, if the bubbles of the evaporated fuel is trapped in the relief path, the bubbles are not exhausted until the pressure relief valve opens, lowering the compressibility and causing the occurrence of the cavitation. According to the present embodiment, upon the engine being started, the fuel passes through the inside of the relief valve structure 200, namely, the periphery of the relief valve spring 200*c* or the ball valve holder 200*e*. Therefore, the bubbles of the evaporated fuel trapped in a portion of the relief valve structure 200 can promptly be exhausted.

Further, it is not necessary to build the relief valve structure 200 and the outlet valve structure 8 separately into the pump body 1. Therefore, it is possible to reduce the amount of path processing of the pump body 1, improving productivity in both the processing and the assembly. Also, it is possible to incorporate the relief valve structure 200 and the outlet valve structure 8 in the automation line at the same time, reducing the number of steps in the automation line.

FIG. 4 shows an example of pressure waveforms in various portions in a state in which, with the high-pressure fuel supply pump, the fuel is normally pressurized to a high pressure and the high-pressure fuel is fed to the common rail 23. A target fuel pressure in the common rail 23 is adjusted to 15 MPa (mega-pascals). The pressure for opening the pressure relief valve 200*b* is adjusted to 18 MPa (mega-pascals).

During an upward-moving motion of the plunger 2 and just after the pump operation changes from the fuel return process to the pressurizing process, a pressure overshoot occurs within the pressurizing chamber 11. The pressure overshoot in the pressurizing chamber 11 is propagated from the high pressure path 12 through a relief path 200*g* (S, R), and a pressure relief valve 200*b*. As a result, the propagated pressure equal to or higher than the pressure for opening the pressure relief valve 200*b* occurs on the inlet side of the pressure relief valve 200*b*. However, the pressure overshoot in the pressurizing chamber 11 also exerts the pressure relief valve 200*b* toward the outlet because the pressure relief valve 200*b* is positioned in the pressurizing chamber 11 outside the outlet. The pressure overshoot in the pressurizing chamber 11 is larger than that in the relief path 200*g*. Consequently, a difference force of both pressure overshoots exerts in a direction of closing the pressure relief valve 200*b* and hence it is possible to prevent the pressure relief valve 102 from erroneously opening.

Thus, even if the high-pressure fuel supply pump is provided, in the outlet joint 12*a*, with the relief valve structure 200 to prevent the occurrence of a damage caused by an abnormal high-pressure in a high-pressure path portion such as the common rail 23 from the downstream side of the outlet valve structure 8, it is possible to attain a high-pressure fuel supply pump which exhibits neither a lowering of flow rate caused by malfunction nor a lowering of volumetric efficiency.

Next, a detailed description will be given below about the case where an abnormal high-pressure occurs in the high-pressure path portions from the downstream of the outlet valve structure 8 to the common rail 23 due to failure or the like of an injector 24.

As the volume of the pressurizing chamber decreases with the motion of the plunger, the internal pressure of the pressurizing chamber increases. When the internal pressure of the pressurizing chamber 11 becomes higher than that of the outlet passage, the outlet valve opens and the fuel is discharged from the pressurizing chamber to the outlet passage. From the instant just after the outlet valve opens, the internal pressure of the pressurizing chamber overshoots and becomes very high.

This high pressure is also propagated into the outlet passage and the internal pressure of the outlet passage also overshoots at the same timing as the pressurizing chamber.

In this case, if the outlet of the pressure relief valve communicates with the inlet passage, because of the pressure overshoot in the outlet passage, the difference in pressure between the inlet and the outlet of the pressure relief valve becomes higher than the pressure for opening the pressure relief valve, resulting in malfunction of the pressure relief valve.

On the other hand, in this embodiment, the outlet of the pressure relief valve communicates to the pressurizing chamber and the internal pressure of the pressurizing chamber consequently exerts the pressure relief valve on the outlet side of the pressure relief valve and the internal pressure of the outlet passage also exerts the pressure relief valve on the inlet side of the pressure relief valve.

Since pressure overshoot is occurring at the same timing within both the interior of the pressurizing chamber and that of the outlet passage, the difference in pressure between the inlet and outlet of the pressure relief valve does not become higher than the pressure for opening the relief valve. That is, the pressure relief valve does not malfunction.

As the volume of the pressurizing chamber increases with the motion of the plunger, the internal pressure of the pressurizing chamber decreases. When the internal pressure of the pressurizing chamber becomes lower than that of the inlet passage, the fuel flows into the pressurizing chamber through the inlet passage. Then, as the volume of the pressurizing chamber again decreases with the motion of the plunger, the fuel is pressurized to a high pressure and is discharged in this state by the mechanism described above.

If a fuel injection valve fails, that is, the injection function stops, and the fuel fed to the common rail cannot be supplied to the associated cylinder, the fuel accumulates between the outlet valve and the common rail, and the fuel pressure becomes abnormally high.

In this case, if the pressure increase is a gentle increase, the abnormal condition is detected by a pressure sensor in the common rail, and a safety function of a flow rate control mechanism in the inlet path is carried out so as to decrease the amount of fuel discharged. However, an instantaneous abnormal increase of pressure cannot be coped with by this feedback control using the pressure sensor.

In the event the flow rate control mechanism in the inlet path or an overflow path should fail and fail to function in the maximum capacity mode, the outlet pressure of high-pressure pump becomes abnormally high in a state of operation for which a large amount of fuel is not required.

In this case, even if the pressure sensor in the common rail detects the abnormally high pressure, it is impossible to remedy this abnormally high pressure condition because the flow rate control mechanism itself is at fault.

Also, when the injection of the injector is stopped after stopping the engine or during the operation, because of the heat on the engine side, it is usually possible that the fuel in the common rail is raised in pressure due to thermal expansion.

When such an abnormally high pressure occurs, the pressure relief valve used in this embodiment functions as a safety valve.

In this case, as the volume of the pressurizing chamber increases with the motion of the plunger, the internal pressure of the pressurizing chamber decreases. When the pressure in the inlet of the pressure relief valve, i.e., the pressure in the outlet passage, becomes higher than the pressure in the outlet of the pressure relief valve, i.e., the internal pressure of the pressurizing chamber, the pressure relief valve opens and allows the abnormally high pressure fuel in the outlet passage to return into the pressurizing chamber. Therefore, the fuel pressure does not rise beyond a prescribed high level even when an abnormally high pressure occurs, that is, the high pressure pipes are protected.

In the case of the first embodiment in which the relief valve structure 200 is installed between the outlet valve structure 8 and the pressurizing chamber 11, during the discharge process, because of the mechanism described above, an inlet-outlet pressure difference equal to or higher than the pressure for opening the pressure relief valve 102 is not developed. Therefore, the pressure relief valve does not open erroneously at the peak pressure during the discharge process.

In both of intake process and fuel return process, the fuel pressure in the pressurizing chamber 11 lowers to a low level equal to that in the intake pipe 28. On the other hand, the pressure in the relief path 200*g* rises to the same level as in the common rail 23. When the difference in pressure between the relief path 200*g* and the pressurizing chamber becomes equal to or higher than the pressure for opening the pressure relief valve 200*b*, the pressure relief valve 200*b* opens. Thereby the fuel whose pressure has become abnormally high is returned from the relief chamber 200*b* to the pressurizing chamber 11, whereby the high pressure pipes, including the common rail 23, are protected.

The high-pressure fuel supply pump is required to pressurize the fuel to a very high pressure of several MPa to several ten MPa, and the pressure for opening the pressure relief valve must be higher than that. If the valve opening pressure is set lower than such a high pressure, the pressure relief valve will open even when the fuel is pressurized normally by the high-pressure fuel supply pump. Such a malfunction of the pressure relief valve causes a decrease of the delivery volume as the high-pressure fuel supply pump and a lowering of the energy efficiency.

Therefore, for setting the opening pressure of the pressure relief valve at such a very high pressure, it is necessary to increase the pressing force of the relief spring, thus inevitably calling for an increase in size of the relief spring.

However, in the case where the relief spring is disposed in the pressurizing chamber or in the relief path located on the pressurizing chamber side, such an increase in size of the pressure relief valve leads to a so much increase in the internal volume of the pressurizing chamber or in a chamber leading to the pressurizing chamber.

The high-pressure fuel supply pump decreases the internal volume of the pressurizing chamber with the motion of the plunger, thereby compressing and pressurizing the fuel and discharging the fuel at a high pressure. Therefore, the more increase in volume of the pressurizing chamber, the larger amount of fuel is pressurized to a high pressure, thus resulting in a lowering of compressibility in the high-pressure fuel supply pump and hence a lowering of energy efficiency.

Further, the fuel in an amount required by the internal combustion engine can no longer be pressurized to a high pressure. On the other hand, in this embodiment, the increase in volume of the pressurizing chamber can be minimized by forming the outlet valve and the pressure relief valve as one piece.

Furthermore, the fuel flowing from the pressurizing chamber 11 into the outlet valve always passes through the inside of the relief valve structure. Therefore, particularly at the time of starting the engine etc., bubbles of air or evaporated fuel are easily exhausted through the outlet valve, preventing the lowering of the compressibility due to the bubbles.

EXAMPLE 2

A second embodiment will be described below with reference to FIG. 6.

Figure 3:
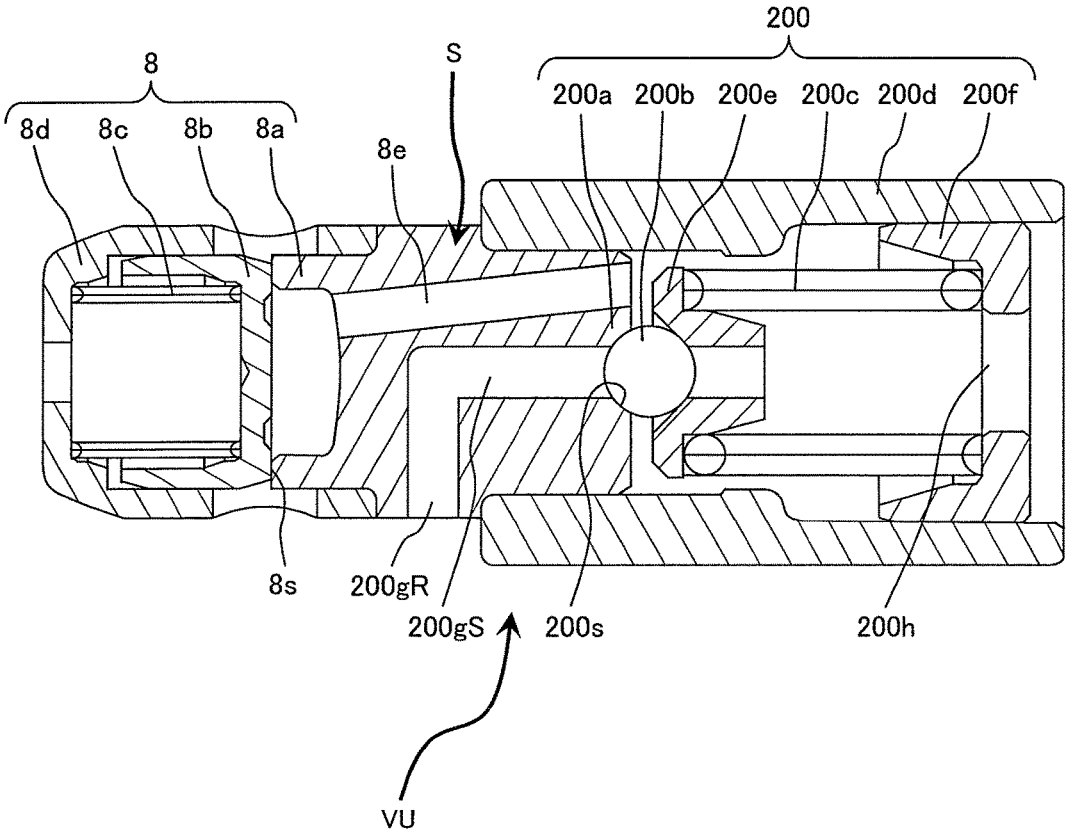
FIG. 3 is a diagram for explaining a unit of a pressure relief valve structure and an outlet valve structure used in the embodiment of the present invention.
Figure 6:
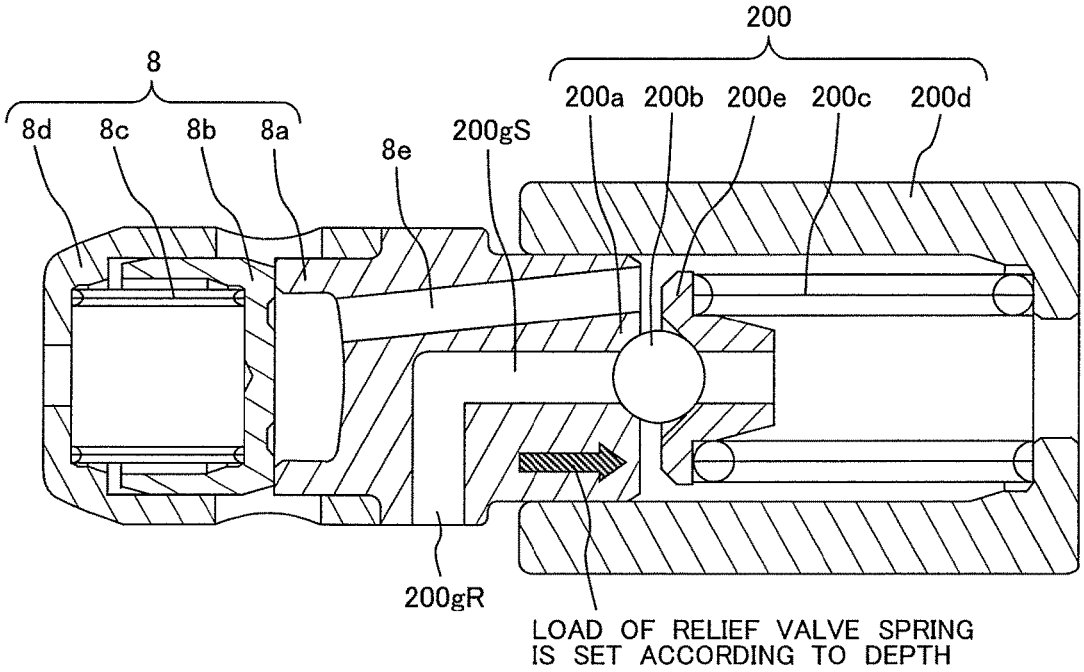
FIG. 6 is a diagram for explaining a unit of a pressure relief valve structure and an outlet valve structure of a second embodiment of the present invention.

In an example shown in FIG. 6, unlike the case in FIG. 3 of the first embodiment, the relief valve spring stopper 200*f* is not provided. Alternatively, the relief valve spring 200*c* is received by a bottom face integrally formed with the relief valve body 200*d*.

The relief valve seat 200*a* (a component formed with the outlet valve seat 8*a* as one piece) is fixed into the relief valve body 200*d* by pressing etc. A load of the relief valve spring 200*c* can be set according to the installation depth of the relief valve seat 200*a*. Thus, the pressure for opening the pressure relief valve can be adjusted or altered.

What is described above is an example for reducing the number of components and raising the productivity. However, the performance of the pressure relief valve is the same as that of the first embodiment.

Also, a second relief path for connecting the downstream side of the outlet valve structure 8 with the low-pressure fuel path on the upstream side of the inlet valve 32 is provided. Further, there is installed, in the second relief path, a second relief valve structure whose set pressure is higher than the set operating pressure of the relief valve structure 200 described above. In this way, a safer system can be obtained.

Further, an orifice 200Y shown in FIG. 4 is for damping a peak pressure in the high pressure path. It may be built into the pump body, provided in the high pressure path, or provided at an inlet of the relief path.

The present embodiment described above has advantages of solving the following problems of the conventional art.

(1) Because the relief valve structure is installed in the pressurizing chamber or in the passage communicating with the pressurizing chamber, the internal volume of the pressurizing chamber increases, lowering the compressibility.

(2) Also, the spring mechanism of the pressure relief valve communicating with the pressurizing chamber is blocked. Therefore, bubbles of air or evaporated fuel hardly exit therethrough, further lowering the compressibility.

According to the present embodiment, even when a relief valve structure for returning the abnormally-high pressurized fuel in the high pressure path to the pressurizing chamber is installed in the pump body, there can be provided a high-pressure fuel pump which allows the bubbles in the pressurizing chamber to exit smoothly, which has high compressibility, namely, whose energy efficiency is high and which has a high performance of raising pressure.

According to the present embodiment, it is possible to provide a high-pressure fuel pump having the following advantages. That is, in the event of occurrence of an abnormally high pressure due to for example failure of a fuel injection valve, fuel pressurized to the abnormally high pressure can be released from the pressure relief valve to the pressurizing chamber. Thus, pipes and other devices of the high-pressure fuel pump are not damaged by the abnormally high pressure. Furthermore, the high-pressure fuel pump which is superior in compressibility, i.e., high in energy efficiency, can be provided while ensuring the above-mentioned advantages.

Aspects of the present embodiments will be summarized as follows.

[First Aspect]

A high-pressure fuel supply pump comprising: a relief path for returning fuel of abnormally high pressure from a high pressure path located downstream of an outlet valve to a pressurizing chamber for pressurizing the fuel; and a relief valve structure for opening and closing the relief path, in which the high-pressure fuel pump is set so that the fuel from the pressurizing chamber flows through the relief valve structure into the outlet valve.

[Second Aspect]

The high-pressure fuel supply pump according to the first aspect, in which the outlet valve seat and the relief valve seat are configured by one component.

[Third Aspect]

The high-pressure fuel supply pump according to the first aspect, in which a path to the outlet valve seat is disposed in a singular or plural number in an outlet valve seat or a relief valve seat.

[Fourth Aspect]

The high-pressure fuel supply pump according to the first aspect, in which the path to the relief valve seat is disposed in a singular or plural number in an outlet valve seat or a relief valve seat.

[Fifth Aspect]

The high-pressure fuel supply pump according to the first aspect, in which the relief valve structure and the outlet valve structure form an independent unit as an assembly.

[Sixth Aspect]

The high-pressure fuel supply pump according to the fifth aspect, in which the assembly unit of the relief valve structure and the outlet valve structure is installed from the inner side of pressurizing chamber.

[Seventh Aspect]

The high-pressure fuel supply pump according to the fifth aspect, in which the assembly unit of the relief valve structure and the outlet valve structure is installed from the outside of the pump.

[Eighth Aspect]

The high-pressure fuel supply pump according to the first aspect, in which at least the pressure relief valve or the outlet valve is installed in the joint for the outlet pipe.

[Ninth Aspect]

The high-pressure fuel supply pump according to the first aspect, in which setting of a spring load of the pressure relief valve is adjusted according to the installation depth of the outlet valve seat or the relief valve seat.

[Tenth Aspect]

The high-pressure fuel supply pump according to the first aspect, in which the relief path is open on a peripheral side face of the pressurizing chamber.

[Eleventh Aspect]

The high-pressure fuel supply pump according to the first aspect, in which the return path is open to a top surface of the pressurizing chamber.

[Twelfth Aspect]

The high-pressure fuel supply pump according to the first aspect, in which the relief path provided with the relief valve structure is provided in a plural number and an outlet of at least one of the plural relief paths is open at a low pressure path.

[Thirteenth Aspect]

The high-pressure fuel supply pump according to the twelfth aspect, in which an operating pressure of the relief valve structure provided in a relief path whose outlet is open at the low pressure path is set so as to be higher than an operating pressure of the relief valve structure provided in the relief path whose outlet is open at the pressurizing chamber.

[Fourteenth Aspect]

The high-pressure fuel supply pump according to the first aspect, in which the valve drive mechanism includes an electromagnetic drive mechanism.

INDUSTRIAL APPLICABILITY

Although the present invention has been described above while making reference as an example to a high-pressure fuel supply pump in a gasoline engine, the present invention is also applicable to a high-pressure fuel supply pump in a diesel engine.

Further, the present invention is applicable to a high-pressure fuel supply pump provided with any type of a flow rate control mechanism independently of the type and mounting position of the flow rate control mechanism.

The invention claimed is:

1. A high-pressure fuel supply pump comprising:

a pressurizing chamber formed in a pump body;

a high pressure path;

an outlet valve structure; and a pressure relief valve structure, wherein a valve seat member is shared by the outlet valve structure and the pressure relief valve structure, and is provided between the pressurizing chamber and the high pressure path;

a pressure relief valve seat for the pressure relief valve structure is provided on a side of the valve seat member that is adjacent to the pressurizing chamber;

an outlet valve seat for the outlet valve structure is provided on a side of the valve seat member that is adjacent to the high pressure path;

one end of a relief path is adjacent to the pressurizing chamber and the other end of relief path is adjacent to the high pressure path, the one end of the relief path opens on a central part of the pressure relief valve seat in the longitudinal direction of the valve seat member, and the relief path is configured to guide fuel toward the pressurizing chamber;

respective first ends of two or more outlet paths are adjacent to the pressurizing chamber and respective second ends of the two or more outlet paths are adjacent to the high pressure path, the first ends of the two or more outlet paths open on peripheral part of the pressure relief valve seat in the longitudinal direction of the valve seat member against the central part, both of the two or more outlet paths are formed in the valve seat member with an inclination against the longitudinal direction of the valve seat member not to join the relief path and configured to guide fuel toward the high pressure path;

the pressure relief valve structure is provided on a side of the valve seat member that is adjacent to the pressurizing chamber;

the outlet valve structure is provided on a side of the valve seat member that is adjacent to the high pressure path; and wherein the relief path comprises a single central axial relief path branching into multiple radial relief paths, an outlet valve holder is provided so that the outlet valve holder encloses the outlet valve seat of the valve seat member, the outlet valve holder comprises a cylindrical portion which encloses an outlet valve spring, each of the multiple radial relief paths are fluidly connected to a gap which is formed between an outer peripheral surface of the valve seat member and an inner peripheral surface of an outlet joint, the gap is fluidly connecting to high pressure path via a second gap which is formed between an outer periphery of the cylindrical portion of the outlet valve holder and an inner periphery of the outlet joint.

2. The high-pressure fuel supply pump according to claim 1, wherein the outlet valve structure and the pressure relief valve structure sandwich the valve seat member, and the one unit is formed as one component.

3. The high-pressure fuel supply pump according to claim 1, wherein the two or more outlet paths open on a bore side of the outlet valve seat.

4. The high-pressure fuel supply pump according to claim 1, wherein an outlet valve holder is fixed to the valve seat member so that the outlet valve holder encloses the outlet valve seat of the valve seat member;

wherein a pressure relief valve body is fixed to the valve seat member so that the pressure relief valve body encloses the pressure relief valve seat of the valve seat member and is formed as a separate member distinct from the outlet valve;

wherein an outlet valve and an outlet spring forming the outlet valve structure are installed in the outlet valve holder; and wherein a relief valve and a relief spring configuring the pressure relief valve structure are installed in the pressure relief valve body.

5. The high-pressure fuel supply pump according to claim 4, wherein the one unit is installed from the inner side of the pressurizing chamber into a through hole which passes through the pressurizing chamber from a sidewall of the pump body.

6. The high-pressure fuel supply pump according to claim 4, wherein the one unit is fitted in an inserted manner from a sidewall of the pump body into a through hole which passes through the pressurizing chamber from the sidewall of the pump body.

7. The high-pressure fuel supply pump according to claim 1, wherein the pressure relief valve structure and the outlet valve structure are covered with an outlet joint welded to a sidewall of the pump.

8. The high-pressure fuel supply pump according to claim 4, wherein setting of a spring load of the pressure relief valve structure or a spring load of the outlet valve structure is adjusted according to installation depth with respect to the valve seat member and the pressure relief valve body or with respect to the valve seat member and the outlet valve holder.

9. The high-pressure fuel supply pump according to claim 1, wherein the relief path opens to a peripheral side face of the pressurizing chamber.

10. The high-pressure fuel supply pump according to claim 1, wherein a pressure relief valve of the pressure relief valve structure is configured by a ball valve and an outlet valve of the outlet valve structure is configured by a flat valve.

11. The high-pressure fuel supply pump according to claim 1, further comprising an additional relief path for connecting the high pressure path with a low pressure path located upstream of an inlet valve provided at an inlet of the pressurizing chamber, and a second pressure relief valve structure provided in the additional relief path, wherein an operating pressure of the second pressure relief valve structure is set to be higher than an operating pressure of the pressure relief valve structure provided in the relief path communicating with the pressurizing chamber.

12. The high-pressure fuel supply pump according to claim 1, further comprising an inlet valve which is controlled to be opened and closed by an electromagnetic drive mechanism.

13. The high-pressure fuel supply pump according to claim 1, wherein the outlet joint is welded to the pump body.

14. A high-pressure fuel supply pump comprising:

a pressurizing chamber formed in a pump body;

a high pressure path;

an outlet valve structure; and a pressure relief valve structure, wherein a valve seat member is shared by the outlet valve structure and the pressure relief valve structure, and is provided between the pressurizing chamber and the high pressure path;

a pressure relief valve seat for the pressure relief valve structure is provided on a side of the valve seat member that is adjacent to the pressurizing chamber;

an outlet valve seat for the outlet valve structure is provided on a side of the valve seat member that is adjacent to the high pressure path;

respective first ends of two or more outlet paths are adjacent to the pressurizing chamber and respective second ends of the two or more outlet paths are adjacent to the high pressure path, both of the two or more outlet paths being formed in the valve seat member and being configured to guide fuel toward the high pressure path;

the pressure relief valve structure is provided on a side of the valve seat member that is adjacent to the pressurizing chamber; and the outlet valve structure is provided on a side of the valve seat member that is adjacent to the high pressure path;

the outlet valve structure, the pressure relief valve structure, and the valve seat member are formed as one unit, a side of the one unit that is closest to the pressure relief valve structure is inserted into a first opening of the pump body, and a side of the one unit that is closest to the outlet valve structure is placed outside of the first opening of the pump body;

an outlet joint surrounds the valve seat member and outlet valve structure, the outlet joint being welded to the pump body, the outlet joint being formed independent from the one unit, a single central axial relief path branches into multiple radial relief paths, an outlet valve holder is provided so that the outlet valve holder encloses the outlet valve seat of the valve seat member, the outlet valve holder comprises a cylindrical portion which encloses an outlet valve spring, each of the multiple radial relief paths are fluidly connected to a gap which is formed between an outer peripheral surface of the valve seat member and an inner peripheral surface of the outlet joint, and the gap is fluidly connected to the high pressure path via a second gap which is formed between an outer periphery of the cylindrical portion of the outlet valve holder and an inner periphery of the outlet joint.

* * * * *